US005851977A

United States Patent [19]

Gorton et al.

[11] Patent Number: 5,851,977

[45] Date of Patent: Dec. 22, 1998

[54] NONFLAMMABLE ORGANIC SOLVENT COMPOSITIONS

[75] Inventors: Earl M. Gorton, Sulphur; Tommy G. Taylor; Ronald D. Olinger, both of Lake Charles, all of La.

[73] Assignee: PPG Industries, Inc., Pittsburgh, Pa.

[21] Appl. No.: 920,098

[22] Filed: Aug. 26, 1997

[51] Int. Cl.[6] ..... C11D 7/50; C11D 7/30; C11D 7/26; B08B 3/08

[52] U.S. Cl. ..... 510/412; 510/175; 510/256; 510/273; 510/365; 252/364; 134/34; 134/42; 134/1.3

[58] Field of Search ..... 510/175, 256, 510/273, 365, 412; 252/364; 134/34, 42, 1.3

[56] References Cited

U.S. PATENT DOCUMENTS

| | | | |
|---|---|---|---|
| 2,999,815 | 9/1961 | Eiseman, Jr. | 252/171 |
| 2,999,817 | 9/1961 | Bower | 252/172 |
| 3,455,835 | 7/1969 | Burt | 252/172 |
| 3,882,568 | 5/1975 | Hill | 15/308 |
| 4,257,860 | 3/1981 | Marling et al. | 204/162 R |
| 4,465,609 | 8/1984 | Denis et al. | 252/67 |
| 4,724,679 | 2/1988 | Radermacher | 62/101 |
| 4,808,331 | 2/1989 | Burt et al. | 252/172 |
| 4,947,881 | 8/1990 | Magid et al. | 134/40 |
| 4,961,869 | 10/1990 | Eggers et al. | 252/170 |
| 4,961,870 | 10/1990 | Cook et al. | 252/171 |
| 4,988,455 | 1/1991 | Magid et al. | 252/171 |
| 5,116,526 | 5/1992 | Magid et al. | 252/172 |
| 5,182,042 | 1/1993 | Van Der Puy | 252/172 |
| 5,207,838 | 5/1993 | Googin et al. | 134/42 |
| 5,250,208 | 10/1993 | Merchant et al. | 252/67 |
| 5,288,819 | 2/1994 | Magid et al. | 252/172 |
| 5,401,429 | 3/1995 | Flynn et al. | 252/171 |
| 5,531,916 | 7/1996 | Merchant | 510/412 |
| 5,607,912 | 3/1997 | Samejima et al. | 510/411 |

FOREIGN PATENT DOCUMENTS

| | | |
|---|---|---|
| WO 91/13934 | 9/1991 | WIPO . |
| WO 95/19947 | 7/1995 | WIPO . |

OTHER PUBLICATIONS

Reductive dehalogenation of polyhalofluorocarbons with tributyltin hydride, *Journal of Fluorine Chemistry*, 71, Elsevier Science S.A., (1995), pp. 59–63.

American Standard Test Method E 681–85, 1994 Annual Book of ASTM Standards, vol. 14.02, American Society for Testing and Materials, Philadelphia, PA, pp. 404–410.

Hawley's Condensed Chemical Dictionary,Eleventh Edition, Van Nostrand Reinhold Company Inc., New York, (1987), pp. 486, 487 and 504.

*Primary Examiner*—Douglas J. McGinty

*Attorney, Agent, or Firm*—Irwin M. Stein; James R. Franks

[57] ABSTRACT

Describes nonflammable organic solvent compositions comprising 1,2-dichloroethylene and a halocarbon different than 1,2-dichloroethylene. The 1,2-dichloroethylene consists essentially of trans-1,2-dichloroethylene, cis-1,2-dichloroethylene and mixtures thereof; preferably a major amount of trans-1,2-dichloroethylene; and in particular at least 99% by weight of trans-1,2-dichloroethylene, based on the total weight of 1,2-dichloroethylene. The halocarbon is selected from the group consisting of 1,1,1,3,3,3-hexafluoroisopropanol, perfluoro-tert-butyl alcohol, 1,1,2,3,3-pentafluoropropane, 1-bromo-2-chloro-1,1,2-trifluoroethane, 1,2-dichloro-1,1,2,3,3,3-hexafluoropropane and mixtures thereof.

18 Claims, No Drawings

NONFLAMMABLE ORGANIC SOLVENT COMPOSITIONS

DESCRIPTION OF THE INVENTION

The present invention is directed generally to organic solvent compositions. In particular, the present invention is directed to an organic solvent composition comprising 1,2-dichloroethylene and a halocarbon which is different than 1,2-dichloroethylene. More particularly, the present invention is directed to such a composition in which the halocarbon is present in an amount sufficient to render nonflammable a homogenous mixture of the organic solvent composition in air. The present invention further relates to the use of said nonflammable composition for cleaning the surface of articles.

The solvent 1,2-dichloroethylene has two geometric isomers; namely, trans-1,2-dichloroethylene (Chemical Abstracts Number (CAS No.) 156-60-5) and cis-1,2-dichloroethylene (CAS No. 156-59-2). The trans and cis geometric isomers of 1,2-dichloroethylene, either together or separately, have a number of uses including: as a solvent for low temperature extraction of organic materials such as dyes, perfumes, lacquers and thermoplastics; as a chemical intermediate in the synthesis of other chlorinated organic compounds; and as a solvent for cleaning articles particularly for metal degreasing. As a cleaning solvent the trans and/or cis geometric isomers of 1,2-dichloroethylene can be used to clean, for example, printed circuit boards, electric motors, compressors, heavy metal parts, delicate precision metal parts, aluminum parts and the like.

The cis and trans isomers of 1,2-dichloroethylene are flammable, and can pose a dangerous fire risk. The flammable nature of these isomers of 1,2-dichloroethylene can make less desirable their use, either together or separately, in a manufacturing facility due, for example, to increased associated costs, such as higher fire insurance premiums.

It is known in the art that certain combinations of organic solvents, such as the trans and/or cis isomers of 1,2-dichloroethylene, and halocarbons, i.e., chlorocarbons (CC's), chlorofluorocarbons (CFC's), hydrochlorocarbons (HCC's), hydrofluorocarbons (HFC's) and hydrochlorofluorocarbons (HCFC's), have been found to form azeotrope or azeotrope-like compositions which are also nonflammable. However, it is also recognized in the art that it is generally not possible to predict whether such compositions will be azeotropic and/or nonflammable. A determination as to the azeotropic and/or nonflammable nature of a solvent composition can typically only be made by rigorous testing and evaluation.

U.S. Pat. Nos. 5,116,526 and 5,288,819 disclose azeotrope-like compositions consisting essentially of dichloropentafluoropropane and 1,2-dichloroethylene which are stable and have utility as solvents in a variety of industrial cleaning applications including cold cleaning and defluxing of printed circuit boards.

International Application WO 95/19947 discloses hydrofluoroalkanes as cleaning and degreasing solvents, especially for vapor degreasing and solvent cleaning, one of which is 1,1,2,3,3-pentafluoropropane. The use of additives, such as inhibitors, surfactants, antioxidants and alcohols, in amounts of from 0.01% to 10% by weight are disclosed.

It would be desirable to have additional novel organic solvent compositions comprising 1,2-dichloroethylene that are liquid at room temperature, nonflammable, and useful as solvents. In accordance with the present invention there is provided an organic solvent composition comprising:

(a) 1,2-dichloroethylene, i.e., trans-1,2-dichloroethylene, cis-1,2-dichloroethylene or mixtures thereof; and (b) a halocarbon selected from the group consisting of 1,1,1,3,3,3-hexafluoroisopropanol, perfluoro-tert-butyl alcohol, 1,1,2,3,3-pentafluoropropane, 1-bromo-2-chloro-1,1,2-trifluoroethane, 1,2-dichloro-1,1,2,3,3,3-hexafluoropropane and mixtures thereof, said halocarbon being present in amounts sufficient to render nonflammable a homogenous mixture of 1,2-dichloroethylene and said halocarbon.

In accordance with another embodiment of the present invention, the aforedescribed organic solvent composition is used to clean surfaces of articles, e.g., metals, such as metal degreasing.

Other than in the operating examples, or where otherwise indicated, all numbers expressing quantities of ingredients or reaction conditions used in the specification and claims are to be understood as modified in all instances by the term "about".

DETAILED DESCRIPTION OF THE INVENTION

Organic solvent compositions in accordance with the present invention have been found unexpectedly to be nonflammable. As used herein, the term organic solvent composition is meant to include a composition which will solvate other organic materials, e.g. oils and greases, and/or disperse inorganic compounds such as soils. By nonflammable is meant, that homogenous mixtures of the organic solvent composition in air, at room temperature and atmospheric pressure, will neither ignite nor propagate a flame when a source of ignition, e.g., an electric arc, is applied thereto. A more detailed description of the apparatus and method used for determining that an organic solvent composition is nonflammable is presented in the Examples. The unexpected nonflammable nature of the organic solvent compositions of the present invention was not predictable and was determined empirically.

The 1,2-dichloroethylene of the organic solvent compositions of the present invention consists essentially of trans-1,2-dichloroethylene, cis-1,2-dichloroethylene and mixtures thereof. In a preferred embodiment of the present invention, the 1,2-dichloroethylene consists essentially of a major amount of trans-1,2-dichloroethylene, i.e., at least 51% by weight, preferably at least 80% by weight, and more preferably at least 90% by weight, based on the total weight of the 1,2-dichloroethylene. In a particularly preferred embodiment of the present invention, the 1,2-dichloroethylene consists essentially of at least 99% by weight of the trans isomer, based on total weight of the 1,2-dichloroethylene.

The 1,2-dichloroethylene and halocarbon of the organic solvent compositions of the present invention are separately known materials. These materials should be used in sufficient purity so as to avoid any adverse influence by impurities in the 1,2-dichloroethylene and halocarbon upon the solvency and nonflammable properties of the resulting organic solvent compositions.

The halocarbon of the organic solvent composition of the present invention is present in an amount at least sufficient to render nonflammable said organic solvent composition. By a sufficient amount is meant that the organic solvent composition has present therein at least an amount of halocarbon that renders the composition nonflammable. However, it is understood that the organic solvent compositions of the present invention may be comprised of an amount of halocarbon, which is in excess of that amount, e.g., as with those compositions according to the present invention that are both nonflammable and azeotropic.

As previously recited, homogenous mixtures of organic solvent compositions according to the present invention are nonflammable in air, i.e., atmospheric air, e.g., air comprised of, exclusive of water vapor, approximately 78% by volume of nitrogen, 21% by volume of oxygen, and the remaining 1% by volume being predominantly carbon dioxide and argon. The air may also have present therein water vapor in amounts up to 100% relative humidity.

In an embodiment of the present invention, the halocarbon is 1,1,1,3,3,3-hexafluoroisopropanol (CAS No. 920-66-1), and is present in an amount sufficient to render nonflammable the homogenous mixture of that halocarbon and 1,2-dichloroethylene. The 1,1,1,3,3,3-hexafluoroisopropanol is present typically in amounts of from 32% to 45% by weight, preferably from 32% to 40% by weight, and more preferably from 32% to 36% by weight, based on the total weight of the organic solvent composition, inclusive of the recited values. The 1,2-dichloroethylene preferably consists essentially of a major amount of trans-1,2-dichloroethylene, and in particular at least 99% by weight of trans-1,2-dichloroethylene, based on the total weight of 1,2-dichloroethylene, and is present in an amount of from 55% to 68% by weight, preferably from 60% to 68% by weight, and more preferably from 64% to 68% by weight, based on the total weight of the organic solvent composition, inclusive of the recited values.

An organic solvent composition according to the present invention comprised of 55% by weight of 1,2-dichloroethylene consisting essentially of at least 99% by weight of the trans isomer, based on the total weight of 1,2-dichloroethylene, and 45% by weight of 1,1,1,3,3,3-hexafluoroisopropanol, based on the total weight of the composition, was found to be nonflammable and azeotropic, having a boiling point of 40.2° C. By azeotropic is meant that the vapor phase and the initial liquid phase were both found to have substantially equivalent compositions.

The boiling point of an azeotrope and its composition can be determined by well known fractional distillation techniques which here included heating, at substantially constant atmospheric pressure, an organic solvent composition according to the present invention until a substantially constant boiling point was observed. At such time, samples of the condensed vapor of the boiling composition were collected and analyzed, e.g., by gas chromatography, to determine its composition. A round bottom flask fitted with a heating mantle, thermometer, agitator and water cooled condenser can be used to determine the azeotropic boiling point.

In another embodiment of the present invention, the halocarbon is perfluoro-tert-butyl alcohol (CAS No. 2378-02-1), and is present in the organic solvent composition in amounts sufficient to render the composition nonflammable. The perfluoro-tert-butyl alcohol is present in an amount of from 26% to 60% by weight, preferably from 26% to 40% by weight, and more preferably from 26% to 30% by weight, based on the total weight of the organic solvent composition, inclusive of the recited values. The 1,2-dichloroethylene preferably consists essentially of a major amount of trans-1,2-dichloroethylene, and in particular at least 99% by weight of trans-1,2-dichloroethylene, based on the total weight of 1,2-dichloroethylene, and is present in an amount of from 40% to 74% by weight, preferably from 60% to 74% by weight, and more preferably from 70% to 74% by weight, based on the total weight of the organic solvent composition, inclusive of the recited values.

An organic solvent composition according to the present invention comprised of 40% by weight of 1,2-dichloroethylene consisting essentially of at least 99% by weight of the trans isomer, based on the total weight of 1,2-dichloroethylene, and 60% by weight of perfluoro-tert-butyl alcohol, based on the total weight of the composition, was found to be nonflammable and azeotropic, having a boiling point of 40.4° C.

In yet another embodiment of the present invention, the halocarbon is 1,1,2,3,3-pentafluoropropane (CAS No. 24270-66-4), and is present in the organic solvent composition in amounts sufficient to render the composition nonflammable. The 1,1,2,3,3-pentafluoropropane is present in an amount of from 60% to 70% by weight, and preferably from 60% to 65% by weight, based on the total weight of the organic solvent composition, inclusive of the recited values. The 1,2-dichloroethylene preferably consists essentially of a major amount of trans-1,2-dichloroethylene, and in particular at least 99% by weight of trans-1,2-dichloroethylene, based on the total weight of 1,2-dichloroethylene, and is present in an amount of from 30% to 40% by weight, and preferably from 35% to 40% by weight, based on the total weight of the organic solvent composition, inclusive of the recited values.

In a further embodiment of the present invention, the halocarbon is 1-bromo-2-chloro-1,1,2-trifluoroethane (CAS No. 354-06-3), and is present in the organic solvent composition in amounts sufficient to render the composition nonflammable. The 1-bromo-2-chloro-1,1,2-trifluoroethane is present in an amount of from 25% to 50% by weight, preferably from 25% to 30% by weight, and more preferably from 25% to 28% by weight, based on the total weight of the organic solvent composition, inclusive of the recited values. The 1,2-dichloroethylene preferably consists essentially of a major amount of trans-1,2-dichloroethylene, and in particular at least 99% by weight of trans-1,2-dichloroethylene, based on the total weight of 1,2-dichloroethylene, and is present in an amount of from 50% to 75% by weight, preferably from 70% to 75% by weight, and more preferably from 72% to 75% by weight, based on the total weight of the organic solvent composition, inclusive of the recited values.

An organic solvent composition according to the present invention comprised of 67% by weight of 1,2-dichloroethylene consisting essentially of at least 99% by weight of the trans isomer, based on the total weight of 1,2-dichloroethylene, and 33% by weight of 1-bromo-2-chloro-1,1,2-trifluoroethane, based on the total weight of the composition, was found to be nonflammable and azeotropic, having a boiling point of 47.6° C.

In yet a further embodiment of the present invention, the halocarbon is 1,2-dichloro-1,1,2,3,3,3-hexafluoropropane (CAS No. 661-97-2), and is present in the organic solvent composition in amounts sufficient to render the composition nonflammable. The 1,2-dichloro-1,1,2,3,3,3-hexafluoropropane is present in an amount of from 25% to 50% by weight, preferably from 25% to 30% by weight, and more preferably from 25% to 28% by weight, based on the total weight of the organic solvent composition, inclusive of the recited values. The 1,2-dichloroethylene preferably consists essentially of a major amount of trans-1,2-dichloroethylene, and in particular at least 99% by weight of trans-1,2-dichloroethylene, based on the total weight of 1,2-dichloroethylene, and is present in an amount of from 50% to 75% by weight, preferably from 70% to 75% by weight, and more preferably from 72% to 75% by weight, based on the total weight of the organic solvent composition, inclusive of the recited values.

Organic solvent compositions according to the present invention may also include effective amounts of conventional additives. By effective amount is meant that amount which results in the desired effect, e.g., rust inhibition or inhibition of oxidation upon storage of the solvent compositions. Classes of additives useful in organic solvent compositions according to the present invention include, but are not limited to, rust inhibitors, corrosion inhibitors, surfactants, emulsifiers, acid scavengers and antioxidants. If present, such additives are typically present in amounts of from 0.01% to 10% by weight, preferably from 0.01% to 5% by weight, and more preferably from 0.01% to 3% by weight, based on the total weight of the organic solvent composition. More specific examples of types of additives useful in the present invention include, but are not limited to: epoxy compounds, such as propylene oxide; nitroalkanes, such as nitromethane; ethers, such as 1,4-dioxane; unsaturated compounds, such as 1,4-butyne diol; acetals or ketals, such as dipropoxy methane; ketones, such as methyl ethyl ketone; alcohols, such as tertiary amyl alcohol; esters, such as triphenyl phosphite; and amines, such as triethyl amine.

The present invention also provides a method of cleaning the surface(s) of an article, e.g., the surface of a metal article, with an organic solvent composition according to the present invention. Methods by which the surface of an article may be cleaned with an organic solvent composition according to the present invention include, but are not limited to: wiping of the surface with rags saturated with the solvent composition; spraying the surface with a high pressure stream of the solvent composition; immersing the surface in a bath of the solvent composition; and exposing the surface to boiling vapors of the heretofore described organic solvent compositions that are both azeotropic and nonflammable. Surfaces of articles that may be cleaned in accordance with the method of the present invention include, but are not limited to: metals, e.g., steel, copper and aluminum; and glass, e.g., the glass in laptop computer screens.

When the surface(s) of an article are cleaned by spray application of an organic solvent composition of the present invention, the composition may be sprayed onto the surface by using a propellant. Classes of propellants useful in the practice of the method of the present invention include, but are not limited to: nonflammable chlorofluorocarbons, e.g., trichlorofluoromethane (known in the art as CFC-11); nonflammable hydrochlorofluorocarbons, e.g., dichlorofluoromethane (known in the art as HCFC-21); air; carbon dioxide; nitrogen; nitrous oxide; and mixtures of these propellants.

The present invention is more particularly described in the following examples, which are intended to be illustrative only, since numerous modifications and variations therein will be apparent to those skilled in the art. Unless otherwise specified, all parts and percentages are by weight.

EXAMPLES 1–7

Table 1 describes comparative organic solvent compositions and those according to the present invention. Examples 1 and 2 represent comparative compositions, while Examples 3 through 7 represent compositions according to the present invention.

The results of an evaluation of the flammability of the organic solvent compositions enumerated in Table 1 are listed in Table 2. The lower and upper flammability limits of the organic solvent compositions of Table 1 were determined using a substantially cylindrical flammability test apparatus having a length of about 91 centimeters (cm) and a diameter of about 5 cm. The test apparatus was equipped with: a magnetically driven stir blade; a mercury manometer; a reversibly sealable injection port; a reversibly sealable vacuum port; a small externally located recirculation tube, which provided communication between the upper and lower interior portions of the test apparatus; and a pair of tungsten electrodes connected to an external electric power source, each having a surface area of 7.5 square millimeters ($mm^2$), and together forming a spark gap of 5.1 millimeters (mm). A substantial portion of the test apparatus was immersed in a temperature controlled oil bath set at 25° C.

A liquid sample of the organic solvent composition to be tested, having a known volume and a temperature of about 25° C., was introduced into the test apparatus through the injection port. Knowing both the volume of the injected liquid sample that was being tested and the internal volume of the test apparatus allowed for an accurate calculation of the percent (%) volume of the solvent composition in air. Next, a vacuum of 15 mm of mercury (mm Hg) was drawn and the stir blade was rotated. After all of the injected liquid sample was observed to have been vaporized, the vacuum was slowly released by allowing air, at ambient temperature and atmospheric pressure, into the testing device. When the vacuum was fully released, the gaseous contents of the sealed test apparatus were stirred for a period of 10 minutes.

After stirring for 10 minutes a spark was generated by applying a potential of 12500 volts across the spark gap of the electrodes, using a high frequency vacuum tester obtained from Electro-Technic Products, model number BD-10 AS. If a flame was observed to propagate through the test apparatus, the calculated % volume of the solvent composition in air was determined to be flammable. Correspondingly, if flame propagation through the test apparatus was not observed, the calculated % volume of the solvent composition in air was determined to be nonflammable.

TABLE 1

| | Examples % By Weight | | | | | | |
|---|---|---|---|---|---|---|---|
| Ingredients | 1 | 2 | 3 | 4 | 5 | 6 | 7 |
| trans-1,2-dichloroethylene[a] | 100 | 0 | 67.5 | 73.5 | 40 | 75 | 75 |
| Benzene[b] | 0 | 100 | 0 | 0 | 0 | 0 | 0 |
| 1,1,1,3,3,3-hexafluoroisopropanol[b] | 0 | 0 | 32.5 | 0 | 0 | 0 | 0 |
| perfluoro-tert-butyl alcohol[b] | 0 | 0 | 0 | 26.5 | 0 | 0 | 0 |
| 1,1,2,3,3-pentafluoropropane[c] | 0 | 0 | 0 | 0 | 60 | 0 | 0 |
| 1-bromo-2-chloro-1,1,2-trifluoroethane[d] | 0 | 0 | 0 | 0 | 0 | 25 | 0 |
| 1,2-dichloro-1,1,2,3,3,3-hexafluoropropane[d] | 0 | 0 | 0 | 0 | 0 | 0 | 25 |

[a]Obtained commercially from PPG Industries, Inc., consisting essentially of 99.7% by weight trans-1,2-dichloroethylene, and less than 0.3% by weight cis-1,2-dichloroethylene.
[b]Obtained commercially from Aldrich Chemical Company.
[c]Synthesized according to the method described by Van Der Puy et al in Journal of Fluorine Chemistry, 71, (1995), pp 59–63.
[d]Obtained commercially from PCR Inc.

The organic solvent compositions of Table 1 were prepared using standard techniques which included: mixing the indicated amounts of ingredients, at room temperature, in an appropriate container; when the combination of ingredients were observed to be homogenous, the organic solvent compositions were each transferred to separate containers, and sealed until evaluated.

TABLE 2

| Examples | LFL[f] | UFL[g] | Flammable? |
|---|---|---|---|
| 1 | 6.5% | 18% | Yes |
| 2 | 1% | 7% | Yes |
| 3 | N.D.[e] | N.D. | No |
| 4 | N.D. | N.D. | No |
| 5 | N.D. | N.D. | No |
| 6 | N.D. | N.D. | No |
| 7 | N.D. | N.D. | No |

[e]N.D. = Not Detected. Flame propagation through the test apparatus was not observed.

[f]LFL = Lower Flammability Limit and is the minimum concentration of an organic solvent composition that is capable of propagating a flame through a homogenous mixture of the organic solvent composition and a gaseous oxidizer, i.e., air, at 25° C. and atmospheric pressure, i.e., approximately 760 torr (1 atmosphere). The LFL values are given in units of % by volume of the organic solvent composition in air. The lower flammability limit is also referred to as the lower explosive limit.

[g]UFL = Upper Flammability Limit and is the maximum concentration of an organic solvent composition that is capable of propagating a flame through a homogenous mixture of the organic solvent composition and a gaseous oxidizer, i.e., air, at 25° C. and atmospheric pressure, i.e., approximately 760 torr (1 atmosphere). The UFL values are given in units of % by volume of the organic solvent composition in air. The upper flammability limit is also referred to as the upper explosive limit.

The LFL and UFL data for Examples 1 and 2 of Table 2 show good agreement with their respective literature values. The LFL and UFL literature values for trans-1,2-dichloroethylene are reported as 6% and 16% by volume respectively, while those for benzene are reported as 1.5% and 8% by volume respectively. See *Hawley's Condensed Chemical Dictionary*, Eleventh Edition, Van Nostrand Reinhold Company, New York. This agreement between experimental data and literature values indicates that the test apparatus and test method used are accurate for determining the LFL and UFL values of the tested organic solvent compositions.

In Table 2 those organic solvent compositions for which lower and upper flammability limits were not detected were determined to be nonflammable, i.e., Examples 3 through 7. Conversely, Examples 1 and 2, for which lower and upper flammability limits were detected, were determined to be flammable within the detected limits. The data of Table 2 shows that organic solvent compositions according to the present invention are nonflammable compared to trans-1,2-dichloroethylene alone.

The present invention has been described with reference to specific details of particular embodiments thereof. It is not intended that such details be regarded as limitations upon the scope of the invention except insofar as and to the extent that they are included in the accompanying claims.

We claim:

1. An organic solvent composition comprising:

(a) from 30% to 75% by weight of 1,2-dichloroethylene; and (b) from 25% to 70% y weight of a halocarbon selected from the group consisting of 1,1,1,3,3,3-hexafluoroisopropanol, perfluoro-tert-butyl alcohol, 1,1,2,3,3-pentafluoropropane, 1-bromo-2-chloro-1,1,2-trifluoroethane, 1,2-dichloro-1,1,2,3,3,3-hexafluoropropane and mixtures thereof, said halocarbon being present in amounts sufficient to render nonflammable a homogenous mixture of 1,2-dichloroethylene and said halocarbon.

2. A method of cleaning a surface of an article comprising applying to said surface a nonflammable homogenous organic solvent composition comprising:

(a) from 30% to 75% by weight of 1,2-dichloroethylene; and (b) from 25% to 70% by weight of a halocarbon selected from the group consisting of 1,1,1,3,3,3-hexafluoroisopropanol, perfluoro-tert-butyl alcohol, 1,1,2,3,3-pentafluoropropane, 1-bromo-2-chloro-1,1,2-trifluoroethane, 1,2-dichloro-1,1,2,3,3,3-hexafluoropropane and mixtures thereof, and removing subsequently said solvent composition from said surface.

3. The composition of claim 1 wherein the 1,2-dichloroethylene is at least 99 % by weight of trans-1,2-dichloroethylene, based on total weight of 1,2-dichloroethylene, and is present in said organic solvent composition in an amount of from 55% to 68% by weight, and said halocarbon is 1,1,1,3,3,3-hexafluoroisopropanol, which is present in an amount of from 32% to 45% by weight.

4. The composition of claim 3 wherein the 1,2-dichloroethylene is present in said organic solvent composition in an amount of from 60% to 68% by weight, and the 1,1,1,3,3,3-hexafluoroisopropanol is present in an amount of from 32% to 40% by weight.

5. The composition of claim 4 wherein the 1,2-dichloroethylene is present in said organic solvent composition in an amount of from 64% to 68% by weight, and the 1,1,1,3,3,3-hexafluoroisopropanol is present in an amount of from 32% to 36% by weight.

6. The composition of claim 1 wherein the 1,2-dichloroethylene is at least 99% by weight of trans-1,2-dichloroethylene, based on the total weight of 1,2-dichloroethylene, and is present in said organic solvent composition in an amount of from 40% to 74% by weight, and said halocarbon is perfluoro-tert-butyl alcohol, which is present in an amount of from 26% to 60% by weight.

7. The composition of claim 6 wherein the 1,2-dichloroethylene is present in said organic solvent composition in an amount of from 60% to 74% by weight, and the perfluoro-tert-butyl alcohol is present in an amount of from 26% to 40% by weight.

8. The composition of claim 7 wherein the 1,2-dichloroethylene is present in said organic solvent composition in an amount of from 70% to 74% by weight, and the perfluoro-tert-butyl alcohol is present in an amount of from 26% to 30% by weight.

9. The composition of claim 1 wherein the 1,2-dichloroethylene is at least 99% by weight of trans-1,2-dichloroethylene, based on the total weight of 1,2-dichloroethylene, and is present in said organic solvent composition in an amount of from 30% to 40% by weight, and said halocarbon is 1,1,2,3,3-pentafluoropropane, which is present in an amount of from 60% to 70% by weight.

10. The composition of claim 9 wherein the 1,2-dichloroethylene is present in said organic solvent composition in an amount of from 35% to 40% by weight, and the 1,1,2,3,3-pentafluoropropane is present in an amount of from 60% to 65% by weight.

11. The composition of claim 1 wherein the 1,2-dichloroethylene is at least 99% by weight of trans-1,2-dichloroethylene, based on the total weight of 12-dichloroethylene, and is present in said organic solvent composition in an amount of from 50% to 75% by weight, and said halocarbon is 1-bromo-2-chloro-1,1,2-trifluoroethane, which is present in an amount of from 25% to 50% by weight.

12. The composition of claim 11 wherein the 1,2-dichloroethylene is present in said organic solvent composition in an amount of from 70% to 75% by weight, and the 1-bromo-2-chloro-1,1,2-trifluoroethane is present in an amount of from 25% to 30% by weight.

13. The composition of claim 12 wherein the 1,2-dichloroethylene is present in said organic solvent composition in an amount of from 72% to 75% by weight, and the 1-bromo-2-chloro-1,1,2-trifluoroethane is present in an amount of from 25% to 28% by weight.

14. The composition of claim 1 wherein the 1,2-dichloroethylene is at least 99% by weight of trans-1,2-dichloroethylene, based on the total weight of 1,2-dichloroethylene, and is present in said organic solvent composition in an amount of from 50% to 75% by weight, and said halocarbon is 1,2-dichloro-1,1,2,3,3,3-hexafluoropropane, which is present in an amount of from 25% to 50% by weight.

15. The composition of claim 14 wherein the 1,2-dichloroethylene is present in said organic solvent composition in an amount of from 70% to 75% by weight, and the 1,2-dichloro-1,1,2,3,3,3-hexafluoropropane is present in an amount of from 25% to 30% by weight.

16. The composition of claim 15 wherein the 1,2-dichloroethylene is present in said organic solvent composition in an amount of from 72% to 75% by weight, and the 1,2-dichloro-1,1,2,3,3,3-hexafluoropropane is present in an amount of from 25% to 28% by weight.

17. The method of claim 2 wherein said article is cleaned by spray application of said organic solvent composition.

18. The method of claim 2 wherein said article is cleaned by immersion in said organic solvent composition.

* * * * *